United States Patent [19]

Nishigaki et al.

[11] 4,335,195

[45] Jun. 15, 1982

[54] ELECTROPHOTOSENSITIVE ELEMENT HAS RESIN ENCAPSULATED CDS PARTICLES IN BINDING RESIN

[75] Inventors: Yuji Nishigaki, Yokohama; Hirokuni Kawashima, Sakurashin, both of Japan

[73] Assignee: Canon Kabushiki Kaisha, Tokyo, Japan

[21] Appl. No.: 175,021

[22] Filed: Aug. 4, 1980

[30] Foreign Application Priority Data

Aug. 10, 1979 [JP] Japan ..... 54-102488

[51] Int. Cl.[3] ..... G03G 5/087

[52] U.S. Cl. ..... 430/94; 430/96

[58] Field of Search ..... 430/94, 96, 84, 89, 430/67

[56] References Cited

U.S. PATENT DOCUMENTS 3,428,452 2/1969 Giaimo ..... 430/91

*Primary Examiner*—John D. Welsh

*Attorney, Agent, or Firm*—Fitzpatrick, Cella, Harper & Scinto

[57] ABSTRACT

An electrophotosensitive member having a photoconductive layer prepared by dispersing in a binding resin, photoconductive powder particles coated with a thermoplastic resin. By the use of the such photoconductive powder particles coated with the resin, there can be provided an electrophotosensitive member particularly excellent in the moisture resistant property.

2 Claims, No Drawings

ELECTROPHOTOSENSITIVE ELEMENT HAS RESIN ENCAPSULATED CDS PARTICLES IN BINDING RESIN

BACKGROUND OF THE INVENTION

This invention relates to an electrophotosensitive member.

The electrophotosensitive member takes various constructions for obtaining predetermined characteristics, or in accordance with kinds of the electrophotographic process to be adopted. As the representative example of the electrophotosensitive member, there is such one that has a photoconductive layer formed on a base member (or a substrate), and such other one that has an insulative layer provided on the surface of the photoconductive layer. These electrophotosensitive members are widely used. The photosensitive member constructed with the substrate and the photoconductive layer is used in the image formation by the most general electrophotographic process, i.e., the image formation by electric charging, imagewise exposure, development, and further, image transfer, depending on necessity. In the photosensitive member having the insulating layer, this insulating layer is for various purposes such as protection of the photoconductive layer, improvement in the mechanical strength of the photosensitive member, improvement in the dark decay characteristics, adaptation of the photosensitive member to a particular electrophotographic process, and various others. Representative examples of the electrophotographic process using the photosensitive member having the insulating layer or the photosensitive member having such insulating member are: U.S. Pat. No. 2,860,048, Japanese Patent Publication No. Sho 41-16429, Japanese Patent Publication No. Sho 38-15446 (corresponding to U.S. Pat. No. 3,146,145), Japanese Patent Publication No. Sho 46-3713 (corresponding to U.S. Pat. No. 3,607,258), Japanese Patent Publication No. Sho 42-23910 (corresponding to U.S. Pat. No. 3,666,363), Japanese Patent Publication No. Sho 43-24748 (corresponding to U.S. Pat. No. 3,734,609), Japanese Patent Publication No. Sho 42-19747 (corresponding to U.S. Pat. No. 3,457,070), Japanese Patent Publication No. Sho 36-4121 (corresponding to U.S. Pat. No. 3,124,456), and others.

The electrophotosensitive member is required, as a matter of course, to have a predetermined sensitivity in accordance with the electrophotographic process to be adopted. The moisture-resistant property of the photoconductive layer is one of the important characteristics of such electrophotosensitive member. In particular, when the photoconductive layer consists of a photoconductive material dispersed in a binding resin, there tends to readily occur deterioration in the electrical charging in connection with moisture.

There has so far been attempted to improve the photoconductive powder with respect to its moisture-resistant property by, for example, controlling a quantity of impurities, or controlling the particle diameter and the shape of powder particles due to the calcining temperature, or selecting the king of resin to be used as the binding resin.

SUMMARY OF THE INVENTION

It is therefore the principal object of the present invention to provide an electrophotosensitive member with improved moisture resistant property by a different way from the conventional one, thereby providing the electrophotosensitive member excellent in its moisture resistant property.

According to the present invention, there is provided an electrophotosensitive member having a photoconductive layer essentially consisting of photoconductive powder particles, the surface of which is coated with a thermoplastic resin, and which are dispersed in a binding resin.

The foregoing object, other objects as well as specific materials to constitute the electrophotosensitive member according to the present invention will become more apparent from the following detailed description thereof in conjunction with a few preferred examples.

DETAILED DESCRIPTION OF THE PREFERRED EMBODIMENT

The photoconductive powder particles to be used for producing the photosensitive member according to the present invention are pre-coated with a thermoplastic resin. By the use of such photoconductive powder, it becomes possible to produce a photosensitive member excellent in its moisture resistant property.

The reason for the intended object of the present invention being achieved by adoption of the photoconductive powder particles coated with a thermoplastic resin is considered as follows. In case the photoconductive powder is dispersed in a binding resin, the content of the binding resin is determined as small as possible so as to give the photosensitive member a sensitivity of a certain definite level or above.

Therefore, while the photoconductive layer to be formed has a stable lamellar structure as a whole, the surface of the photoconductive powder particle per se is not necessarily coated perfectly by the binding resin, but these powder particles are bound by the resin in a state of considerable gaps being present among the powder particles. Therefore, paying attention to one of the photoconductive powder particles, a surface part of the powder particle is covered with the binding resin, while the other surface part thereof is exposed uncoated, which is considered the cause for lowering the moisture resistant property due to influence of the atmosphere. Consequently, it is considered that the improvement in the moisture resistant property could be realized by pre-coating the surface of the photoconductive powder particles with the resin so as to eliminate the exposed part from the powder particles.

It may, of course, be possible that the resin to precoat the photoconductive powder particles is the same as, or different from, the binding resin. In this case, the resin having good moisture resistant property is used for coating the photoconductive powder particles, and the resin having good film shapeability and adhesive property is properly used for the binding resin, hence selection of the resin to be used becomes more free as a whole, which is favorable. It is also preferable that the resin for precoating the photoconductive powder particles has affinity for the binding resin.

Thickness of the thermoplastic resin to be coated on the photoconductive powder particles may be extremely thin. It may be sufficiently as thin as an order of milli-micron. Since it is not easy at all to directly and accurately measure the thickness of the coating film, the degree of coating is controlled by adjusting the quantity of use of the thermoplastic resin for coating. Usually, it is preferable to coat 0.03 to 3 parts by weight, more particularly, 0.1 to 1 part by weight, of the resin with respect to 100 parts by weight of the photoconductive powder particles.

In this way, there can be obtained the photosensitive member which maintains good photoconductive property, has high durability, in particular, less charge deterioration in conjunction with humidity, and is less affected by the surrounding atmosphere such as vapor, ozone, and so forth, due to the thermoplastic resin coating on the photoconductive powder particles.

The representative construction of the photosensitive member according to the present invention is classified into two groups: the one constructed with the substrate and the photoconductive layer, and the other constructed with the substrate, the photoconductive layer, and the insulating layer on the photoconductive layer.

As the substrate, there may be used electrically conductive substrates, for example, metals such as Al, Cr, Mo, Au, In, Nb, Ta, V, Ti, Pt, Pd, etc. or alloys of these metals or insulative substrates such as glass, the surface of which is treated with $In_2O_3$, $SnO_2$, etc. to be electrically conductive, synthetic resin film such as polyimide film etc. which have been treated by the vacuum vapor deposition electron beam vapor deposition, sputtering, and so forth to deposit on its surface those metals such as Al, Ag, Pd, Zn, Ni, Au, Cr, Mo, Ir, Nb, Ta, V, Ti, Pt, and so on. It is also possible to render the surface of such synthetic resin film electrically conductive by lamination of the abovementioned metals.

The shape of the substrate may be arbitrarily determined such as a cylindrical shape, web shape, planar shape, and others. In the case of the continuous high speed reproduction, it is desirable to form it in an endless belt or cylindrical shape.

Thickness of the substrate can be arbitrarily determined. In case flexibility is required of the substrate, it can be made as thin as possible within a permissible range for the substrate to sufficiently exhibit its function. In such case, however, the thickness is usually 10 microns or more from the standpoints of convenience in manufacturing the substrate, its handling, its mechanical strength, and so forth.

The resin for coating the photoconductive powder particles is usually selected from ordinary thermoplastic resins. The representative resins are, for example, hydrophobic resins such as polyethylene, polyester, polypropylene, polystyrene, polyvinyl chloride, polyvinyl acetate, acryl resin, silicone resin, fluorine-containing resin, vinyl chloride/vinyl acetate copolymer, vinyl chloride/vinylidene chloride copolymer, polystyrene/-butadiene copolymer, and the like.

The photoconductive powder may be selected from oxides, sulfides, iodides, selenides of metals such as Zn, Hg, Al, Sb, Bi, Cd, Mo, and so forth. Examples of these compounds are: zinc oxide, cadmium sulfide, zinc sulfide, cadmium selenide, lead oxide, arsenic sulfide, titanium oxide, zinc-titanium oxide, zinc-silicon oxide, zinc-magnesium oxide, mercury iodide, mercury oxide, mercury sulfide, indium sulfide, calcium-strontium sulfide, and the like.

Content of the binding resin to form the photoconductive layer preferably ranges from 0.5 to 50 parts by weight, or more particularly, from 5 to 20 parts by weight per 100 parts by weight of the photoconductive powder coated with a thermoplastic resin.

Thickness of the photoconductive layer is, in general, from 5 to 100 microns, or preferably, from 10 to 50 microns, although it depends on the kind and characteristics of the photoconductive layer to be used.

Various kinds of ordinary resins can be arbitrarily used as the resin for forming the insulating layer to be provided on the photosensitive member. Examples of such resins are: polyethylene, polyester, polypropylene, polystyrene, polyvinyl chloride, polyvinyl acetate, acryl resin, polycarbonate, silicone resin, fluorine-containing resin, epoxy resin, and the like. Thickness of the insulating layer ordinarily ranges from 0.1 to 100 microns, or more specifically, from 0.1 to 50 microns.

EXAMPLE 1

100 g. of photoconductive CdS powder (average particle diameter of 2 microns) is dried for 30 minutes at 100° C., after which the powder is added to and sufficiently agitated in a solution of 0.5 g. of acryl resin (a product of Mitsubishi Rayon K.K. and sold under a tradename of "LR-574") in 100 g. of toluene. Therefore, toluene is evaporated by continuously agitating the solution by blowing cold air, and the solution is further heated to dry up in a drying furnace for 30 minutes at 60° C. to perfectly evaporate toluene, whereby CdS powder coated with a thin film of acryl resin is obtained. Subsequently, 100 g. of this CdS powder is mixed with a solution of 10 g. of vinyl chloride/vinyl acetate copolymer resin (a product of Union Carbide Corporation and sold under tradename of "VMCH") in 100 g. of butyl acetate, followed by milling by a three-roll mill so as to knife-coat the mixture solution on an aluminum foil of 50 microns thick. After drying the coating until no finger print relief is left on the coating when lightly touched by a finger, it is heated in a drying furnace for 30 minutes at 70° C. and dried. Thickness of the photoconductive layer after the drying is 40 microns. As an insulating layer, polyethylene terephthalate film of 25 microns thick is attached onto the surface of the photoconductive layer with an adhesive agent, thereby obtaining an electrophotosensitive member.

EXAMPLE 2

A mixture solution of the following composition is prepared.

| | |
|---|---|
| CdS powder | 100 g. |
| Silicone resin (a product of Shinetsu Kagaku K.K. and sold under a tradename of "KR-255") | 0.3 g. |
| Toluene | 100 g. |

In the same manner as in Example 1 above, toluene is evaporated to obtain CdS powder coated with thin film of silicone resin.

Subsequently, another mixture solution of the following composition is prepared.

| | |
|---|---|
| CdS powder coated with silicone resin | 100 g. |
| Acryl resin (a product of Mitsubishi Rayon K.K. and sold under a tradename of "LR-574") | 15 g. |
| Toluene | 100 g. |

In the same manner as in Example 1 above, the mixture solution is coated on an aluminum foil, to which a polyethylene terephthalate film is further adhered, thereby making an electrophotosensitive member. Thickness of the photoconductive layer is 40 microns.

EXAMPLE 3

A mixture solution of the following composition is prepared.

| | |
|---|---|
| CdS powder | 100 g. |
| Vinyl chloride/vinyl acetate copolymer resin ("VMCH") | 0.5 g. |
| Methyl ethyl ketone | 100 g. |

In the same manner as in Example 1 above, methyl ethyl ketone is evaporated from this mixture solution to obtain CdS powder coated with thin film of a vinyl chloride/vinyl acetate copolymer resin.

Subsequently, another mixture solution of the following composition is prepared.

| | |
|---|---|
| CdS powder coated with vinyl chloride/vinyl acetate copolymer resin | 100 g. |
| Vinyl chloride/vinyl acetate copolymer resin ("VMCH") | 12 g. |
| Butyl acetate | 100 g. |

In the same manner as in Example 1 above, the electrophotosensitive member having thereon the photoconductive layer of 40 microns thick is obtained from the above mixture solution.

EXAMPLE 4

A mixture solution of the following composition is prepared.

| | |
|---|---|
| CdS powder | 100 g. |
| Vinylidene chloride/acrylonitrile copolymer (a product of Toa Gosei Kagaku K.K. and sold under a tradename of "ARON CX-S-2") | 1 g. |
| Toluene | 100 g. |

In the same manner as in Example 1 above, toluene is evaporated from this mixture solution to thereby obtain CdS powder coated with thin film of vinylidene chloride/acrylonitrile copolymer.

Subsequently, another mixture solution of the following composition is prepared.

| | |
|---|---|
| CdS powder coated with vinylidene chloride/acrylonitrile copolymer | 100 g. |
| Vinyl chloride/vinyl acetate copolymer ("VMCH") | 12 g. |
| Butyl acetate | 100 g. |

In the same manner as in Example 1 above, an electrophotosensitive member having thereon the photoconductive layer of 40 microns thick is obtained from the mixture solution.

The production of CdS powder coated with the resin according to the foregoing Examples 1 through 4 is verified in the following manner. That is, when the untreated CdS powder is put in a 50% aqueous solution of hydrochloric acid, it is dissolved within five seconds to become colorless, while generating hydrogen sulfide gas. On the other hand, the CdS powder coated with the resin is not dissolved in the hydrochloric acid solution even after lapse of five minutes, from which it is seen that the resin forms the substantially perfect coating. Next, durability tests are conducted on the photosensitive members produced by Examples 1 to 4 and a reference photosensitive member produced according to Example 1 without coating the CdS powder with the resin with respect to their charge characteristic in relation to temperature by use of a reproduction apparatus through the process steps of primary positive charging, secondary A.C. discharging simultaneously with imagewise exposure and blanket exposure in an atmosphere of 85% RH (relative humidity) at 25° C. Further, the photosensitive member which has been left for a full one day in an atmosphere of 100% RH at 25° C. is subjected to a forced charged deteriorating device to measure the contrast potential before and after it. The results of the tests are shown in the following Table.

| Photosensitive Member | Durability Test by Reproduction Apparatus in Atmosphere of 85% RH | Rate of Sustaining Contrast Potential After Forced Charge Deterioration |
|---|---|---|
| Comparative Sample | Image density lowered to 50% or below at 5,000th sheet | 15% |
| Example 1 | Image density sustained 80% and above at 5,000th sheet | 80% |
| Example 2 | Image density sustained 80% and above at 5,000th sheet | 90% |
| Example 3 | Image density sustained 80% and above at 5,000th sheet | 75% |
| Example 4 | Image density sustained 80% and above at 5,000th sheet | 85% |

What we claimed is:

1. An electrophotosensitive member having a photoconductive layer consisting essentially of cadmium sulfide powder particles encapsulated in a thermoplastic resin, said encapsulated particles dispersed in a binding resin, wherein the weight ratio of said thermoplastic resin to said powder particles is from 0.03:100 to 3:100.

2. Process for preparing the member of claim 1 comprising dispersing a flowable coating comprising a photoconductive powder coated with a thermoplastic resin in a nonaqueous carrier containing a binder resin, and applying said coating to a substrate, wherein the weight ratio of said thermoplastic resin to said powder particles is from 0.03:100 to 3:100.

* * * * *